United States Patent [19]

Daniels

[11] 3,999,761

[45] Dec. 28, 1976

[54] ACTIVITY BLOCK AND METHOD OF MAKING SAME

[75] Inventor: Richard James Daniels, Caledonia, Wis.

[73] Assignee: Western Publishing Company, Inc., Racine, Wis.

[22] Filed: Nov. 6, 1975

[21] Appl. No.: 629,482

[52] U.S. Cl. ..... 273/137 B; 35/71

[51] Int. Cl.[2] ..... A63F 9/20

[58] Field of Search ..... 35/9 D, 69, 70, 71; 40/152, 156; 46/25; 273/137 B, 137 C, 137 D

[56] References Cited

UNITED STATES PATENTS

| | | | |
|---|---|---|---|
| 2,873,976 | 2/1959 | Alatorre | 273/137 C |
| 3,005,282 | 10/1961 | Christiansen | 46/25 |
| 3,423,866 | 1/1969 | Bott | 40/156 X |
| 3,561,146 | 2/1971 | Dembar | 35/69 UX |
| 3,774,339 | 11/1973 | Swett | 35/69 UX |

FOREIGN PATENTS OR APPLICATIONS

| | | | |
|---|---|---|---|
| 965,867 | 2/1950 | France | 273/137 C |
| Ad. 73,742 | 5/1960 | France | 273/137 C |
| 1,293,047 | 4/1962 | France | 273/137 C |

*Primary Examiner*—Harland S. Skogquist
*Attorney, Agent, or Firm*—Arthur J. Hansmann

[57] ABSTRACT

An activity block and method of making same, wherein the block includes a box-shaped body piece having windows therein and having a sheet visible through the windows and having a backing piece which snaps into the body piece for holding the sheet in the windows.

2 Claims, 4 Drawing Figures

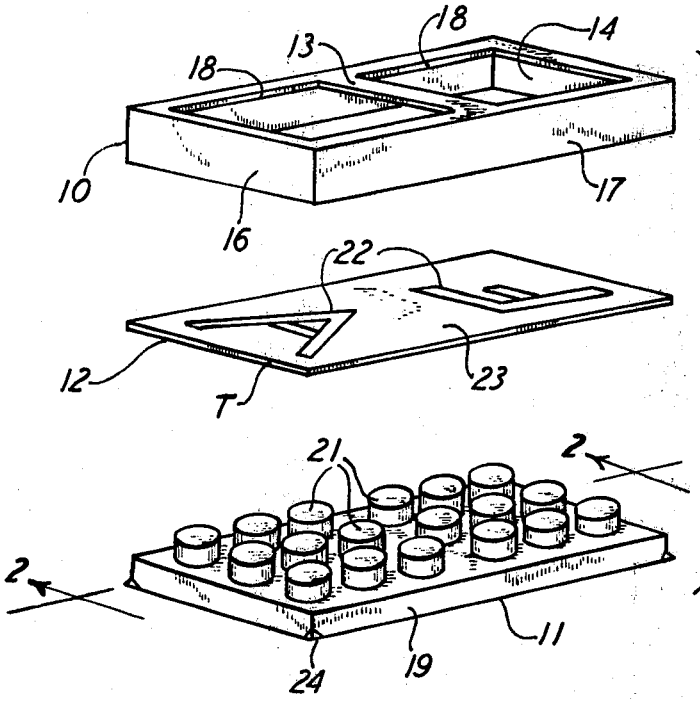
FIG. 1
FIG. 4
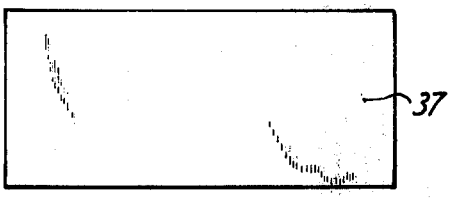
FIG. 3
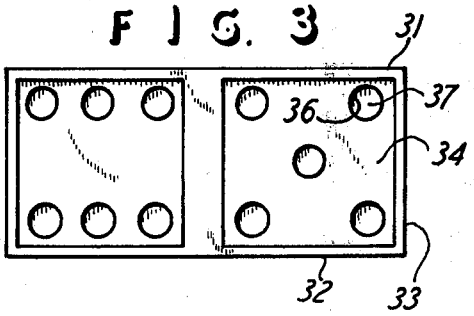
FIG. 2
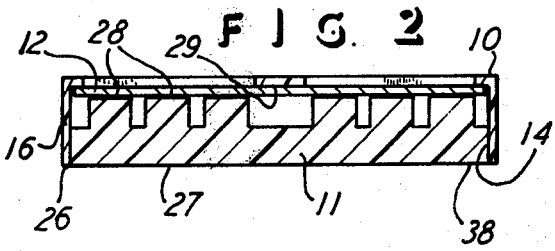

ACTIVITY BLOCK AND METHOD OF MAKING SAME

This invention relates to an activity block and method of making same, and it is particularly useful for providing an activity block used in educational and amusement activities, and it can include a domino block and an alphabet-type of block, and the like.

BACKGROUND OF THE INVENTION

The prior art is aware of the activity blocks, and methods of making same, such as shown in U.S. Pat. Nos. 91,234 and 274,668 and 2,873,976. Also, the prior art is aware of providing activity blocks of the domino and alphabet types, but these blocks are commonly provided in the form of a single solid block having the dots formed in the face thereof, for the domino activity, or having readable indicia on the face thereof, such as lettering or numbers or the like.

However, in the instances of the prior art, the activity blocks are expensive to manufacture and require special molds and dyes, or they are tooled or machine cut, such as the common standard blocks made of wood. In those prior art instances, the blocks are not of any close consistency in overall size and in configuration and in general aesthetic qualities. Further, the blocks of the prior art do not lend themselves to the versatility of readily selecting and even readily changing the message or indicia of the blocks, such as the appearance of numbers or letters or even the coloring of the eyes of the domino-type block.

Accordingly, it is a primary object of this invention to provide an activity block which improves upon the prior art blocks, and wherein the block of the present invention specifically overcomes the limitations mentioned with regard to the prior art. In accomplishing these objectives, the block of the present invention is one which can be provided with a significant degree of consistency to have uniformity among the blocks in a set of blocks and to still have the blocks inexpensively but sturdily manufactured. Specifically, the block of this invention can be made of plastic material, and the blocks can be readily and easily assembled by simply snapping a body piece and a backing piece into an assembled position.

Still further, the present invention provides a means for presenting visible indicia on an activity block but without requiring any careful attention of hand tooling or decorating, as in the prior art, and the block of the present invention can provide the desirable visible indicia in an expedient and variable and readily provided manner. Further, in accomplishing the aforementioned objectives, the block of the present invention lends itself to changes in the visible indicia in each block. Accordingly, the activity block of this invention is arranged to provide a two-color type of block, but the multicolor appearance is achieved by simply utilizing a sheet, such as a piece of paper, having either a solid color or lettering or numbers thereon, and with the sheet being visible through a window in the body of the block.

Other objects and advantages will become apparent upon reading the following description in light of the accompanying drawings.

BRIEF DESCRIPTION OF THE DRAWINGS

FIG. 1 is an exploded perspective view of the three elements constituting the activity block of this invention.

FIG. 2 is a sectional view of the assembly of the three elements shown in FIG. 1, and with the section being along the line 2—2 of FIG. 1.

FIG. 3 is a top plan view of a modified form of the block shown in FIGS. 1 and 2.

FIG. 4 is a top plan view of the sheet used in the block in FIG. 3.

DETAILED DESCRIPTION OF THE PREFERRED EMBODIMENT

FIG. 1 shows the activity block of this invention to consist of a body piece 10, a backing piece 11, and a sheet 12. It will further be understood that this block can be used as an activity block for dominos, amusement events, educational purposes, and the like. The body piece 10 is shown to be box-shaped and has a rectilinear configuration in that it is composed of a face portion 13 extending across the breadth and width of the piece 10, and it has a hollow interior 14 which is defined by four sides, two of which are designated 16 and two of which are designated 17. Thus the body piece 10 is made of one continuous material in the box shape shown and described, and the sides 16 and 17 are integral with the face portion 13 and extend at right angles from the plane of the face portion 13, as shown. Further, the face portion 13 is provided with openings or windows designated 18, and two such windows are shown in the FIG. 1 embodiment, and these windows extend completely through the face portion 13 and are shown to be rectilinear.

The backing piece 11 consists of a planar plate portion 19 and a plurality of upstanding projections or lugs 21 which are integral with the portion 19. Also, the sheet 12 is preferably of a heavy stock paper material, and it has of course a certain thickness designated T, and it may be provided with special indicia, such as the letters 22 shown on the face 23 of the sheet 12 in FIG. 1.

Thus, with reference to FIGS. 1 and 2, it will now be seen and understood that the activity block of this invention consists of the three pieces 10, 11, and 12, and these pieces are assembled together in the position shown in FIG. 2. In the assembly, the backing piece 11 is tightly and snugly disposed within the confines of the sides 16 and 17 of the body piece 10, and, in fact, the backing piece 11 snaps into the body piece 10 to be held therein but it can be snapped out and removed therefrom. Thus, it will be understood that the body piece 10 is of a slightly flexible material, and particularly it is flexible in the arrangement and presentation of its sides 16 and 17 to thus accommodate the snap fit of the backing piece 11. Further, the backing piece 11 has projecting corners 24 which are spaced apart slightly more than the spacing of the corners of the body piece 10, and the corners 24 therefore serve to snugly snap the backing piece 11 into the hollow interior 14 of the body piece 10, in the FIG. 2 orientation of assembly movement of the pieces.

Therefore, when the pieces 10 and 11 are in their final assembled position, as shown in FIG. 2, then the lower edges 26 of the four sides 16 and 17 are on the same common plane as the surface 27 of the backing piece 11, as shown in FIG. 2. Also, in that assembled position, the backing piece 11 is of a height which extends to a plane on which the backing piece upper surface 28 is located, and that surface 28 is slightly spaced from the undersurface 29 of the body piece face portion 13. Further, the spacing between the face portion 13 and the backing piece 11 is equal to the thickness T of the sheet 12, and thus the sheet 12 snugly fills the space mentioned. Accordingly, the sheet 12 is held upwardly by the backing piece 11 and is presented to be viewed through the windows 18, since the sheet 12 thus extends across the windows 18, as shown in FIG. 2. The sheet 12 is also of a length and width to be equal to that of the length and width of the body piece 10 such that the four edges of the sheet 12 extend immediately adjacent the respective four sides 16 and 17 of the body piece 10, and thus the sheet 12 is aligned with the body piece 10 and is secured therein in the direction of the plane of the sheet 12 itself.

With the arrangement thus described, the activity block of this invention can be readily and easily made and the sheet 12 is presented for viewing the indicia thereon through the windows 18. Also, the manufacture and the ultimate assembly of the three pieces of the block is an easy task but yet an attractive and highly functional and sturdy block is provided. Accordingly, the letters 22, as shown in FIG. 1, are arranged on the sheet 12 to align with the windows 18 to be viewed therethrough when the block is in the assembled position of FIG. 2. Of course it will be understood that other indicia, instead of the shown letters 22 of FIG. 1, could be provided on the sheet 12, such as by printing or painting or the like.

FIGS. 3 and 4 show the activity block of this invention utilized for presenting a domino block, and here the block has a body piece designated 31, and that piece will have its four sides comparable to the four sides of FIG. 1 and two of those sides are designated 32 and two are designated 33, in FIG. 3. Further, the block 31 has its face portion 34, but, in this instance, the face portion 34 has a plurality of circular openings 36 extending therethrough, in place of the windows 18 but extending through like the arrangement of the windows 18 in FIG. 1. That is, the block 31 is also box-shaped and is of a hollow interior having sides 32 and 33 integral with a face portion 34 which has a plurality of circular openings 36 extending therethrough and into the body piece hollow interior. Also, the body piece 31 has a backing piece 11, like the piece shown in FIGS. 1 and 2, snapped into the body piece 31, as previously described in connection with FIGS. 1 and 2. Finally, the domino block of FIGS. 3 and 4 is provided with a blank sheet of paper 37 which has no special indicia shown thereon in FIG. 4, and that paper 37 is visible through the openings 36, as seen in FIG. 3. With that arrangement, the so-called eyes of the domino block, as defined by the windows 36, are presented by the paper 37. Therefore, the domino block body 31 could be of one color material, such as a light color like an off-white or the like, and the sheet 37 could be completely black, and thus the domino block eyes would appear black in the FIG. 3 assembly and view. In this manner, a domino block is provided and it is attractive, inexpensive to manufacture, and variable in that various color combinations between the body 31 and the sheet 37 can be arranged, both in assembly and by the ultimate user who can remove the backing piece 11 and insert a different sheet 37, if desired. However, the sheet 37 is described as having visible indicia thereon, namely the black coloring itself, or some other contrasting visible color or indicia apparent through the openings 36.

With the arrangement of the domino block in FIGS. 3 and 4, the plurality of upstanding lugs 21, as seen in FIGS. 1 and 2, is preferably arranged so that the total of the eighteen lugs 21 align with the total combination of holes 36 which can be provided in the domino block body 31, and thus the sheet 37 is assured of being tightly and snugly presented across the windows or openings 36. Additionally, the backing piece 11 is made with the lugs 21 so that the sheet 12 will not be inadvertently wrinkled by a continuous surface on the plane designated 28 in FIG. 2, and the backing piece 11 will require only a minimum of material and will therefore be inexpensive and lightweight, as desired but still the backing piece 11 will serve its desired function of snugly holding the sheets 12 and 37 upwardly against the undersurface of the body piece face portions, as described.

The method of manufacturing the activity block will be apparent from the foregoing description and from the drawings and from the following description. The pieces 10 and 11 are preferably made of a plastic material which is of course formed in a mold to achieve the final configurations shown in the drawings. Also, the sheets 12 and 37 are preferably of a paper stock material which is cut to a size to fit within the hollow interior of the respective body pieces 10 and 31, as described and as best shown in FIG. 2. Finally, the three pieces of both activity blocks shown are then assembled by having the respective sheets positioned on the undersurface of the face portions 13 and 34, and then the backing piece 11 is positioned at the hollow interior of the respective body piece 10 and 31 and the backing piece 11 is then snapped tightly and firmly into the respective body piece which has the corners 24 for the snap action described. In that manner, the method of making the activity block can be achieved. In that construction and method, the respective body pieces 10 and 31 thus have an open side designated 38, and that side is in the box-shaped body piece located opposite from the respective face portion 13 and 34, and then the backing piece 11 is disposed in the open side 38 since the overall size of the backing piece 11 is equal to the overall size of the open side 38. Therefore, the backing piece portion 19 is rectangular in shape and is snap-fitted into the respective body pieces and it therefore completes the construction of the block and holds the respective paper sheet in an immovable position and snugly against the undersurface of the respective face portion. Since the body piece 10 is made of a plastic material, and it has the relatively thin-walled and extending four sides 16 and 17, the backing piece corners 24, being slightly wedge-shaped as shown in FIG. 1, will be wedged into the interior corners of the body pieces for the snap fit action described. Of course the sheets 12 and 37 could be of a plastic or material other than paper, but it is intended that the sheets give visible indicia or color contrast to the respective face portions described. No cement or solvents are required for securing the pieces together, and no hand tooling or hand painting or decorating is required in order to get the color contrasts described, and the variable patterns are endless, depending upon the indicia of the respective sheets 12 and 37, as mentioned.

What is claimed is:

1. An activity block of the educational and amusement types, comprising a hollow body piece having a face portion and spaced-apart sides extending from said face portion and defining the hollow interior of said body piece and terminating in edges disposed on a common plane, said face portion having a plurality of windows extending therethrough, a backing piece including a portion of an overall size equal to the spacing between said sides and being snap-fitted into said hollow interior and with said portion extending along said common plane and said backing piece including projections extending from said portion to a plane spaced from said face portion and being of a number at least that of said plurality of said windows and being disposed with one of said projections aligned with a respective one of said windows and with each of said projections being of a transverse size equal to the size of each of said windows for projecting fully in said windows, an indicia sheet in said hollow interior in the space between said face portion and said plane of said projections and disposed to extend snugly across said windows and being of an overall size equal to the spacing between said sides to be confined by said sides and being of a thickness equal to the spacing between said face portion and said projections and being in contact therewith and immovably confined therebetween, said sheet being of visible contrast with said face portion and being visibly exposed in said windows.

2. The activity block as claimed in claim 1, wherein said body piece is of a rectilinear box shape having an open side defined by said edges, said backing piece being rectangular in shape and snugly disposed in said open side, both said pieces being of a plastic material for the snapping together in their assembled relationship, and said backing piece portion having projections on the edges of the rectangular shape thereof for snapping into said rectilinear body piece and thereby locating said backing piece projections in contact with said sheet.

* * * * *